US011313362B2

(12) United States Patent
Matsuo et al.

(10) Patent No.: US 11,313,362 B2
(45) Date of Patent: Apr. 26, 2022

(54) TUBEPHRAGM PUMP

(71) Applicant: IWAKI CO., LTD., Tokyo (JP)

(72) Inventors: Shigeyoshi Matsuo, Sayama (JP); Hiroyuki Tanabe, Sayama (JP); Motohiro Tanaka, Sayama (JP)

(73) Assignee: IWAKI CO., LTD., Tokyo (JP)

( * ) Notice: Subject to any disclaimer, the term of this patent is extended or adjusted under 35 U.S.C. 154(b) by 36 days.

(21) Appl. No.: 16/781,088

(22) Filed: Feb. 4, 2020

(65) Prior Publication Data

US 2020/0277947 A1 Sep. 3, 2020

(30) Foreign Application Priority Data

Feb. 28, 2019 (JP) ..... JP2019-035538

(51) Int. Cl.
*F04B 43/00* (2006.01)
*F04B 43/08* (2006.01)
(Continued)

(52) U.S. Cl.
CPC ..... *F04B 43/0072* (2013.01); *F04B 43/08* (2013.01); *F04B 43/084* (2013.01);
(Continued)

(58) Field of Classification Search
CPC .... F04B 43/0072; F04B 43/082; F04B 43/08; F04B 43/084; F04B 45/022; F04B 45/024;
(Continued)

(56) References Cited

U.S. PATENT DOCUMENTS 1,922,196 A * 8/1933 Butler ..... F04B 43/0072 417/475
2,249,806 A * 7/1941 Bogoslowsky ..... F04B 43/0072 418/45
(Continued)

FOREIGN PATENT DOCUMENTS

JP S52-28006 A 3/1977
JP S53-24605 A 3/1978
(Continued)

OTHER PUBLICATIONS

Apr. 2, 2019 Notice of Reasons for Rejection issued in Japanese Patent Application No. 2019-035538.

*Primary Examiner* — Peter J Bertheaud
(74) *Attorney, Agent, or Firm* — Oliff PLC

(57) ABSTRACT

A tubephragm pump includes a tubephragm that has a pump head portion that forms a pump chamber, a driving head that holds the tubephragm and expands and contracts the pump chamber by directly pressing and pulling the pump head portion in a direction intersecting with a transfer direction of a transfer fluid, a driving unit that drives the driving head back and forth in a driving direction to expand and contract the pump chamber, and a control unit that controls the driving unit. The tubephragm is in a flat shape with a cross-sectional shape intersecting with the transfer direction of the transfer fluid of the pump chamber having a length in a direction intersecting with the driving direction longer than a length in the driving direction. A pair of liquid contacting surfaces opposing in the driving direction of the pump chamber move while maintaining a parallel state.

20 Claims, 5 Drawing Sheets

(51) Int. Cl.
*F04B 45/02* (2006.01)
*F04B 45/027* (2006.01)

(52) U.S. Cl.
CPC ..... *F04B 43/086* (2013.01); *F04B 45/02* (2013.01); *F04B 45/027* (2013.01); *F04B 43/0054* (2013.01); *F04B 43/082* (2013.01); *F04B 45/022* (2013.01); *F04B 45/024* (2013.01)

(58) Field of Classification Search
CPC .... F04B 43/0054; F04B 45/02; F04B 45/027; F04B 43/086
See application file for complete search history.

(56) References Cited

U.S. PATENT DOCUMENTS 2,251,235 A * 7/1941 Weydell ..... F04B 43/123 418/45
2,553,247 A * 5/1951 Fowler ..... F04B 45/022 417/412
2,899,906 A * 8/1959 Becher ..... F04B 43/0072 417/477.6
4,131,399 A 12/1978 Calvet

FOREIGN PATENT DOCUMENTS

JP S58-118281 U 8/1983
JP 2004-293782 A 10/2004
JP 2009-047090 A 3/2009

* cited by examiner

B- B' Enlarged cross- sectional surface

A- A' Enlarged cross- sectional surface

TUBEPHRAGM PUMP

CROSS-REFERENCE TO RELATED APPLICATIONS

This application is based upon and claims the benefit of priority from the prior Japanese Patent Application No. 2019-35538, filed on Feb. 28, 2019, the entire contents of which are incorporated herein by reference.

BACKGROUND OF THE INVENTION

Field of the Invention

The present invention relates to a tubephragm pump.

Description of the Prior Art

There is known a tubephragm pump (for example, see Japanese Unexamined Patent Application Publication No. 2009-047090) that deforms a tubephragm as a tubular flexible member to feed a minute flow amount of transfer fluid. This type of tubephragm pump contracts and expands the tubephragm to transfer the transfer fluid by pressurizing and depressurizing a pressure transmitting medium outside the tubephragm.

SUMMARY OF THE INVENTION

However, the tubephragm pump disclosed in the above-described Japanese Unexamined Patent Application Publication No. 2009-047090 contracts and expands the tubephragm that can change a volume of a pump chamber by the pressure transmitting medium made of a polymer gel. In view of this, while a leakage and generation of air bubbles can be reduced compared with a case where a liquid, such as water and oil, is used as the pressure transmitting medium, a problem of the leakage is caused because the pressure transmitting medium still needs to be enclosed in a pump head. In addition, this type of tubephragm pump has problems of a complicated replacement of the tubephragm and a difficulty in achieving a downsized pump head.

If the leakage of the pressure transmitting medium occurs by any chance, a contaminated pump peripheral environment becomes a problem, and, in the tubephragm having a cross-sectional shape in a circular shape, which is usually used, there is caused a problem of failing to provide a linearity between a deformation amount (crushing amount) of the tubephragm and a discharge amount of transfer fluid.

The present invention has been made in consideration of the above-described circumstances, and it is an objective of the present invention to provide a tubephragm pump that eliminates the need for a pressure transmitting medium that operates a tubephragm and ensures making the tubephragm easily replaceable while providing a linearity between a deformation amount of the tubephragm and a discharge amount of a transfer fluid.

A tubephragm pump according to one embodiment of the present invention includes a tubephragm, a driving head, a driving unit, and a control unit. The tubephragm has a pump head portion that forms a pump chamber into which a transfer fluid is introduced and from which the introduced transfer fluid is discharged to an outside. The driving head holds the tubephragm. The driving head expands and contracts the pump chamber by directly pressing and pulling the pump head portion in a direction intersecting with a transfer direction of the transfer fluid. The driving unit drives the driving head back and forth in a driving direction to expand and contract the pump chamber. The control unit controls the driving unit. The tubephragm is in a flat shape with a cross-sectional shape intersecting with the transfer direction of the transfer fluid of the pump chamber having a length in a direction intersecting with the driving direction by the driving unit longer than a length in the driving direction by the driving unit. A pair of liquid contacting surfaces opposing in the driving direction of the pump chamber move while maintaining a parallel state.

In the tubephragm pump according to one embodiment of the present invention, the control unit controls the driving unit such that the driving head is driven back and forth with a stroke with which the pair of liquid contacting surfaces opposing in the driving direction of the pump chamber are not brought into contact with one another.

In another embodiment of the tubephragm pump, the tubephragm has a rib that projects outward in the driving direction of the pump chamber on an outer peripheral surface side of the pump chamber.

In another embodiment of the tubephragm pump, the driving head includes a fixing member that sandwiches the rib.

In another embodiment of the tubephragm pump, the tubephragm has a cross-sectional shape perpendicular to the transfer direction of the pump chamber in a hexagonal shape, an oval-like shape, or an elliptical shape.

In another embodiment of the tubephragm pump, the tubephragm has a wall thickness of wall portions opposing in the driving direction thicker than a wall thickness of wall portions opposing in a direction intersecting with the driving direction on a cross-sectional surface perpendicular to the transfer direction of the pump chamber.

Effects of the Invention

The present invention eliminates the need for a pressure transmitting medium that operates a tubephragm and ensures making the tubephragm easily replaceable while providing a linearity between a deformation amount of the tubephragm and a discharge amount of a transfer fluid.

The accompanying drawings, which are incorporated in and constitute a part of the specification, illustrate embodiments of the invention, and together with the general description given above and the detailed description of the embodiments given below, serve to explain the principles of the invention.

DESCRIPTION OF THE PREFERRED EMBODIMENTS

The following describes a tubephragm pump according to embodiments of the present invention in details by referring to the accompanying drawings. However, the following embodiments do not limit the invention according to each of the claims, and all the combinations of features described in the embodiments are not necessarily required for the solution of the invention.

First Embodiment

Configuration of Tubephragm Pump and Pump System

Figure 1:
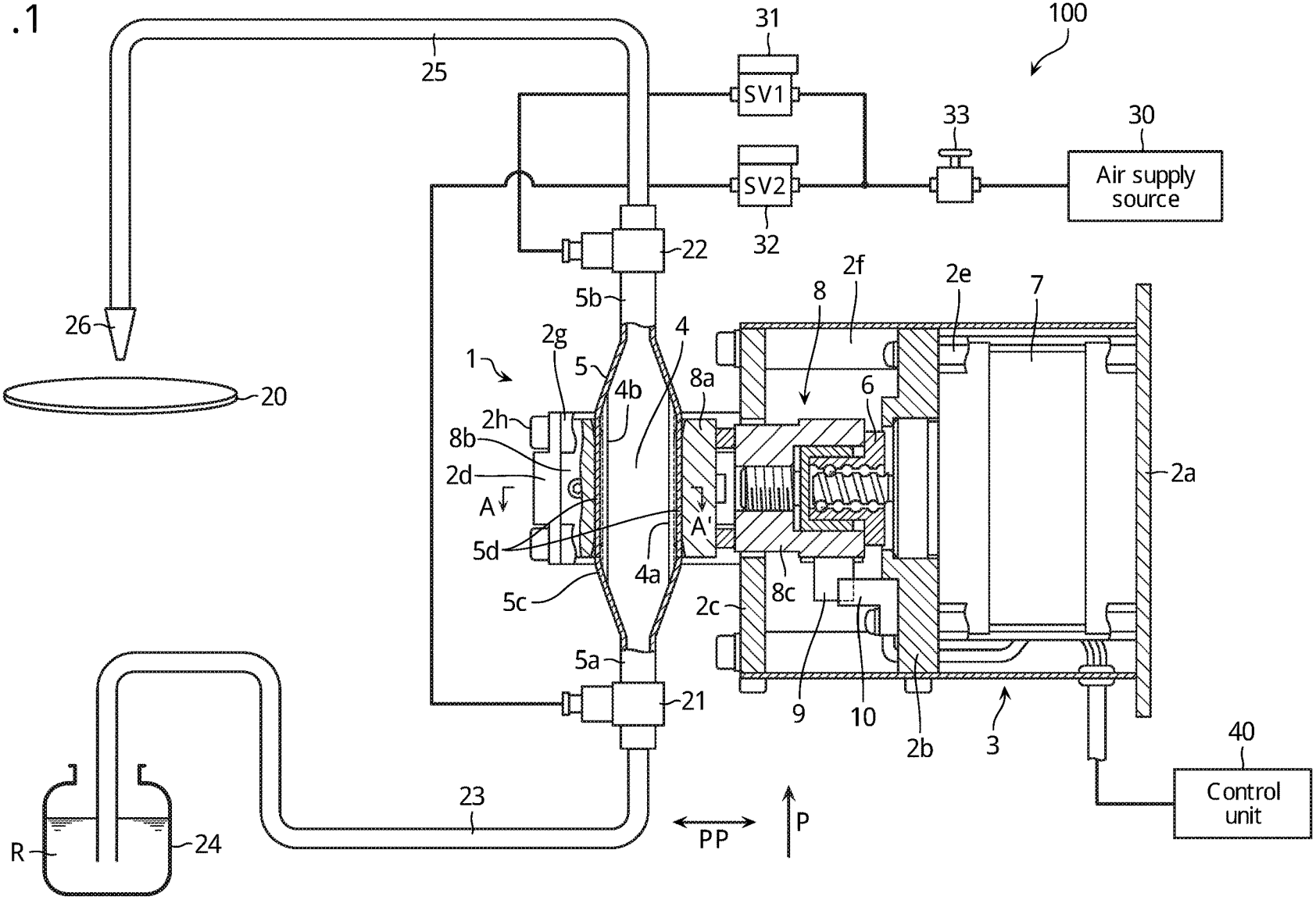
FIG. 1 is an explanatory drawing that schematically illustrates an overall configuration of a tubephragm pump according to one embodiment of the present invention.

FIG. 1 is a drawing that illustrates an overall configuration of a pump system 100 including a tubephragm pump 1 according to an embodiment. While the tubephragm pump 1 of the embodiment is used, for example, as a metering pump, and feeds, for example, a resist R to be applied on an upper surface of a semiconductor wafer 20 as a transfer fluid, the present invention is not limited to this. It should be noted that FIG. 1 illustrates a state of the tubephragm pump 1 when a suction process of the resist R is terminated, and FIG. 2 illustrates a state of the tubephragm pump 1 when a discharge process of the resist R is terminated.

Figure 2:
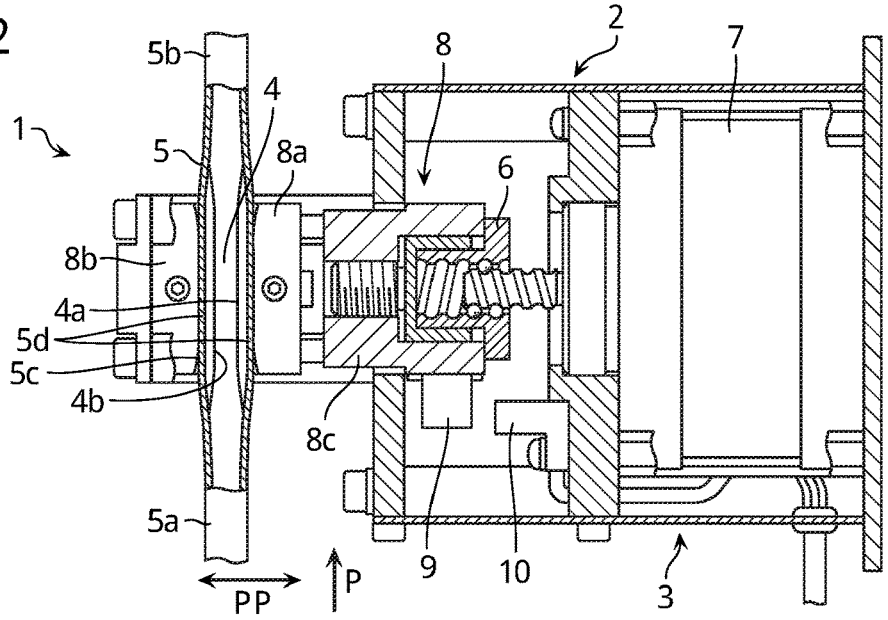
FIG. 2 is an explanatory drawing that schematically illustrates a configuration of the same tubephragm pump.
Figure 3:
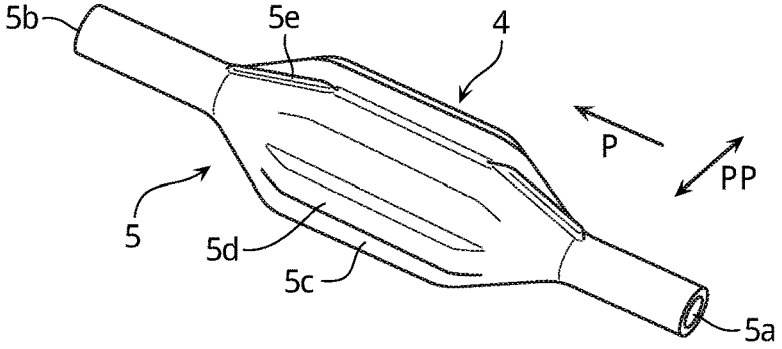
FIG. 3 is a perspective view that illustrates a tubephragm of the same tubephragm pump.
Figure 4:
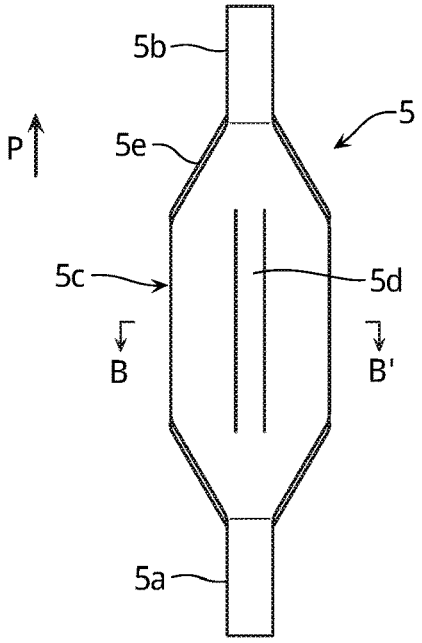
FIG. 4 is a plan view that illustrates the same tubephragm.
Figure 5:
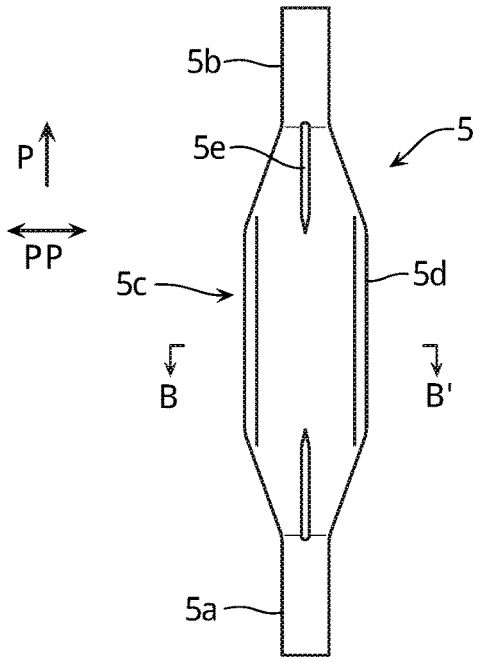
FIG. 5 is a side view that illustrates the same tubephragm.

As illustrated in FIG. 1 and FIG. 2, the tubephragm pump 1 includes a pump main body 3 fixed to a fixing portion (not illustrated) and a tubephragm 5 driven by this pump main body 3.

The pump main body 3 includes a driving head 8 that holds and presses the tubephragm 5, and a stepping motor 7 as a driving unit that drives this driving head 8 via a ball screw 6. The pump main body 3 is supported by a frame 2. The frame 2 is configured of a plurality of frame bodies 2*a*, 2*b*, 2*c*, and 2*d*, a plurality of support pillars 2*e*, 2*f*, and 2*g* that fix between these frame bodies 2*a* to 2*d*, and the like. The frame body 2*a* is fixed to a fixing portion (not illustrated). The stepping motor 7 is held between the frame bodies 2*a* and 2*b*. The stepping motor 7 has a driving shaft coupled to the driving head 8 via the ball screw 6.

The driving head 8 includes fixing members 8*a* and 8*b* that hold the tubephragm 5, and a driving member 8*c* that drives the fixing member 8*a* back and forth. The driving member 8*c* passes through a center hole of the frame body 2*c* and is coupled to the ball screw 6 to be driven back and forth. The fixing member 8*a* is fixed to a distal end of the driving member 8*c*. The fixing member 8*b* is fixed to a rear surface of the frame body 2*d* in a front and is disposed opposing to the fixing member 8*a*. The fixing members 8*a* and 8*b* hold the tubephragm 5 from the front and the rear. The frame body 2*d* can be appropriately removed from the frame body 2*c* with screws 2*h*.

Figure 6:
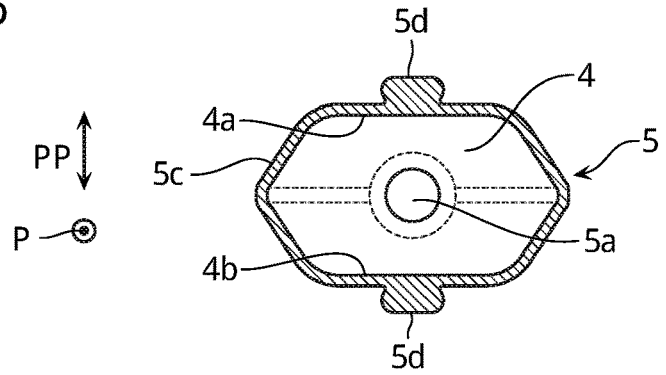
FIG. 6 is an enlarged cross-sectional view taken along the line B-B□ in FIG. 4.

The tubephragm 5 is formed of, for example, a perfluoroalkoxy alkane (PFA), and is formed by blow molding. As illustrated in FIG. 3 to FIG. 6, the tubephragm 5 has a suction port 5*a* and a discharge port 5*b* in cylindrical shapes coaxially disposed in an upper portion and a lower portion thereof, and has a widen pump head portion 5*c* between the suction port 5*a* and the discharge port 5*b*. The pump head portion 5*c* internally has a pump chamber 4 and is directly pressed and pulled in a driving direction PP by the driving head 8. In view of this, the pump chamber 4 expands and contracts. The pump operation in association with this expansion and contraction transfers the resist R as the transfer fluid into the pump chamber 4 along a transfer direction P (first direction). A cross-sectional shape perpendicular to the transfer direction P of the pump head portion 5*c* of the tubephragm 5 has a flat shape with a length in a direction (third direction) that intersects with a driving direction PP (second direction) of the pump head portion 5*c* longer than that in the driving direction PP (second direction) of the pump head portion 5*c* as illustrated in FIG. 6.

That is, the tubephragm 5 has a cross-sectional shape intersecting with the transfer direction P (first direction) of the pump head portion 5*c* in a flat shape with a length in the direction (third direction) intersecting with the transfer direction P (first direction) and the driving direction PP (second direction) longer than the length of the driving direction PP (second direction). The tubephragm 5 has the suction port 5*a* provided on one side of the transfer direction P (first direction) of the pump head portion 5*c* and the discharge port 5*b* provided on the other side, and the cross-sectional surface that intersects with the transfer direction P (first direction) of the pump head portion 5*c* is formed to be larger than the cross-sectional surface intersecting with the transfer direction P (first direction) of the suction port 5*a* and the discharge port 5*b*.

The tubephragm 5 has the cross-sectional shape perpendicular to the transfer direction P of the transfer fluid of the pump head portion 5*c* formed to have, for example, a hexagonal shape in the embodiment. It should be noted that the cross-sectional shape of the pump chamber 4 is not limited to this.

The tubephragm 5 has a pair of ribs 5*d* formed to project outward in the driving direction PP and extend along the transfer direction P on an outer peripheral surface side of the pump head portion 5*c* in the embodiment. As illustrated in FIG. 6, these ribs 5*d* have the cross-sectional surfaces perpendicular to the transfer direction P formed to be in inverted trapezoids in which widths increase as projecting out from the outer peripheral surface side of the pump head portion 5*c*. It should be noted that the cross-sectional shape of the rib 5*d* is not limited to this.

Figure 7:
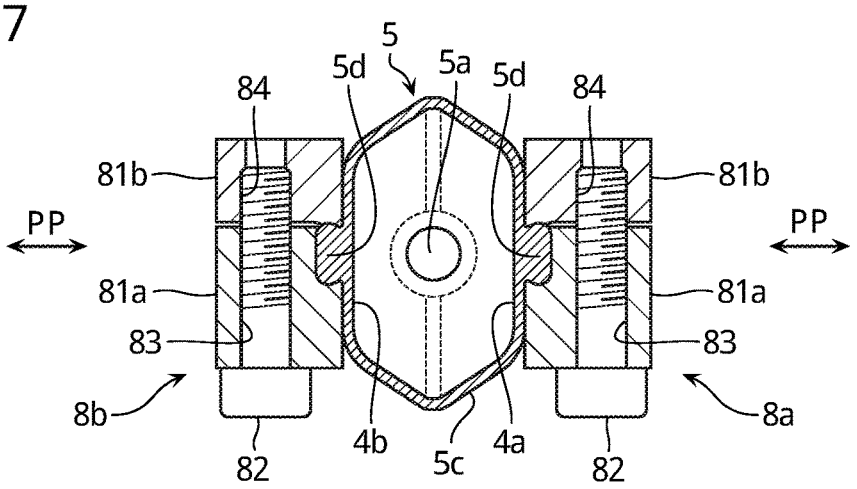
FIG. 7 is an enlarged cross-sectional view taken along the line A-A□ in FIG. 1.

The rib 5*d* of the tubephragm 5 is sandwiched between the fixing members 8*a* and 8*b* of the driving head 8 as illustrated in FIG. 7. That is, the fixing members 8*a* and 8*b* are configured by including respective first metal fittings 81*a* having through-holes 83, respective second metal fittings 81*b* having screw holes 84, and respective bolts 82 mounted in the through-holes 83 and the screw holes 84.

Sandwiching the rib 5*d* with the first metal fitting 81*a* and the second metal fitting 81*b* and fastening the first metal fitting 81*a* and the second metal fitting 81*b* with the bolt 82 removably fix the tubephragm 5 onto the fixing members 8*a* and 8*b*.

Ribs 5*e* are formed at portions that widen from the suction port 5*a* and the discharge port 5*b* to the pump head portion 5*c* on the outer surface in the direction perpendicular to the transfer direction P and the driving direction PP of the tubephragm 5.

The suction port 5*a* of the tubephragm 5 is connected to a suction valve 21 made of an air controlled valve, and the discharge port 5*b* of the tubephragm 5 is connected to a discharge valve 22 made of an air controlled valve. The suction port 5*a* of the tubephragm 5 is connected to a resist bottle 24 in which the resist R is accumulated via the suction valve 21 and a pipe 23. The discharge port 5*b* of the tubephragm 5 is connected to a nozzle 26 via the discharge valve 22 and a pipe 25. Meanwhile, the air supplied from an air supply source 30 is supplied to a first solenoid valve (SV1) 31 and a second solenoid valve (SV2) 32 via a pressure regulating valve 33. The first solenoid valve 31 supplies an air for open/close driving to the discharge valve 22. The second solenoid valve 32 supplies an air for open/close driving to the suction valve 21.

The driving member 8*c* of the driving head 8 has a lower end portion to which a blocking plate 9 is mounted. This blocking plate 9 is detected by a home position sensor (photo sensor) 10 disposed adjacent to a position where the fixing member 8*a* is separated farthest from the fixing member 8*b* in the pump main body 3, that is, a position where the driving member 8*c* retreats the most. A control unit 40 can control the stepping motor 7, the first solenoid valve 31, and the second solenoid valve 32 based on a predetermined timing preliminarily set or a signal from the home position sensor 10. In the former case, the control unit 40 can execute an error process, such as an error indication and an error alarm, by determining that the driving member 8*c* did not return to its origin based on the signal from the home position sensor 10.

Operation of Tubephragm Pump 1

The tubephragm pump 1 thus configured causes the driving member 8*c* of the driving head 8 to move forward in the driving direction PP by the stepping motor 7 in a discharge operation of the resist R by a control by the control unit 40. This presses the pump head portion 5*c* of the tubephragm 5 by the fixing members 8*a* and 8*b*, and opposing liquid contacting surfaces 4*a* and 4*b* of the pump chamber 4 being brought close to one another contracts the pump chamber 4.

Meanwhile, in a suction operation of the resist R, the stepping motor 7 retreats the driving member 8*c* of the driving head 8 in the driving direction PP. This causes the pump head portion 5*c* of the tubephragm 5 to be directly pulled by the fixing members 8*a* and 8*b* to expand the pump chamber 4 and to return to its original position. Accordingly, it eliminates the need for a conventional pressure transmitting medium that operates the tubephragm 5, and therefore, a problem, such as a reduced discharge amount, caused by a leakage of an enclosed liquid and air generation in the enclosed liquid is not caused.

Here, in the case where the whole tubephragm 5 were in a cylindrical shape including the pump head portion 5*c*, an area of the cross-sectional surface perpendicular to the transfer direction P would not change much at the beginning of contraction of the pump chamber 4 but a deformation amount would vary as the contraction process advances. Therefore, a linearity between a deformation amount (crushing amount) of the pump chamber 4 of the tubephragm 5 and a discharge amount of the resist R cannot be ensured to cause a problem that a quantitative determination control is difficult.

In contrast to this, the tubephragm pump 1 according to the embodiment has the cross-sectional surface perpendicular to the transfer direction P of the pump chamber 4 in a flat shape, more specifically, a hexagonal shape. Therefore, the liquid contacting surfaces 4*a* and 4*b*, while maintaining a parallel state without changing much, move in the direction to be close to one another. At this time, in the case where the portion of the rib 5*e* easily deforms, a deformation of the liquid contacting surfaces 4*a* and 4*b* can be further reduced. Thus, the tubephragm pump 1 of the embodiment ensures a large variation amount of a cross-sectional area with respect to an extension/contraction stroke from the beginning of the contraction of the pump chamber 4, and moreover, a constant change over the whole contraction process. Accordingly, the tubephragm pump 1 of the embodiment ensures providing a linearity between the deformation amount (crushing amount) of the pump chamber 4 of the tubephragm 5 and the discharge amount of the resist R in the discharge operation.

It should be noted that the control unit 40 controlling the stepping motor 7 so as to drive the driving head 8 back and forth with a stroke with which the liquid contacting surfaces 4*a* and 4*b* opposing in the driving direction PP of the pump chamber 4 are not brought into contact with one another ensures reducing generation of dust inside the resist R, and also ensures extending a service life of the tubephragm 5.

A replacement of the tubephragm 5 can be easily performed by removing the tubephragm 5 from the fixing members 8*a* and 8*b*, the suction valve 21, and the discharge valve 22. In view of this, at the time of a chemical liquid adhesion and a chemical liquid replacement, it is only necessary to replace the tubephragm 5 alone, thereby facilitating the maintenance. Changing a size of the tubephragm 5 ensures easily changing the maximum discharge amount of the tubephragm pump 1, thereby ensuring an enlarged applicable discharge range.

Operation of Pump System 100

Next, an operation of the pump system 100 using the tubephragm pump 1 is described.

It should be noted that, in the following description, it is assumed that one cycle of operation is started from a standby state (state illustrated in FIG. 1) where the tubephragm 5 is at its original position with the resist R having already been filled within the pump chamber 4. A CW pulse signal output from the control unit 40 rotates a motor shaft of the stepping motor 7 clockwise (CW) to cause the ball screw 6 to move forward toward the tubephragm 5. Meanwhile, a CCW pulse signal output from the control unit 40 rotates the motor shaft of the stepping motor 7 counterclockwise (CCW) to retreat the ball screw 6 so as to move away from the tubephragm 5.

Figure 8:
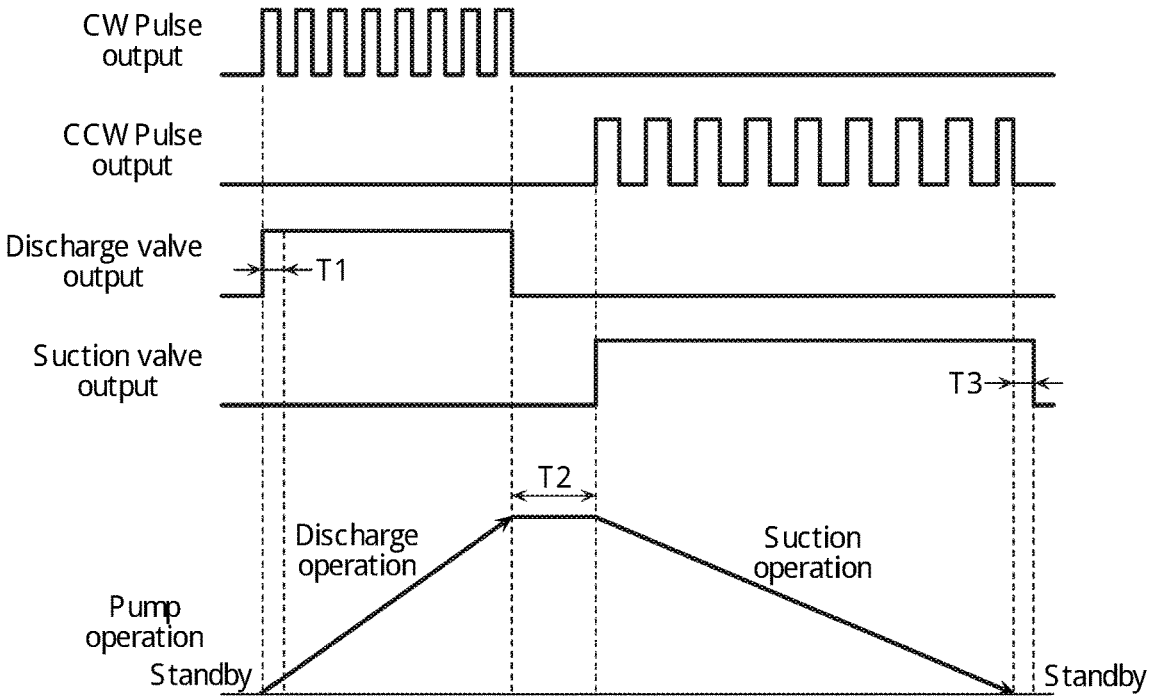
FIG. 8 is a timing chart that illustrates an operation of the same tubephragm pump.

As illustrated in FIG. 8, in the standby state, the control unit 40 outputs the CW pulse signal to the stepping motor 7. Together with this, the control unit 40 turns the first solenoid valve 31 ON (the SV1 is ON) to turn the discharge valve 22 ON. That is, as soon as the CW pulse signal is output, the stepping motor 7 moves the ball screw 6 forward in a direction to crush the tubephragm 5 with the driving head 8. As soon as the first solenoid valve 31 is turned ON, the air supplied to the first solenoid valve 31 via the pressure regulating valve 33 from the air supply source 30 turns the discharge valve (air controlled valve) 22 ON to open between the discharge port 5*b* and the pipe 25 and nozzle 26. This starts a discharge operation of the tubephragm pump 1.

It should be noted that a predetermined time T1 is a delay in order to prevent a pulling-back phenomenon when a liquid end of the resist R is pulled back to a side of the pump chamber 4 due to an effect of the discharge valve 22 when the discharge starts. Accordingly, when the pulling-back phenomenon occurs, the discharge valve 22 is simply controlled to be turned ON after delaying for the predetermined time T1.

When the discharge operation starts, the pump chamber 4 of the tubephragm 5 continues to contract while being directly pressed by the driving head 8 with the liquid contacting surfaces 4*a* and 4*b* maintaining the state parallel to one another. This discharges (applies) the resist R by a volume displaced by the contraction of the pump chamber 4 onto the upper surface of the semiconductor wafer 20 through the discharge port 5*b*, the discharge valve 22, the pipe 25, and the nozzle 26 from the pump chamber 4.

During the discharge operation, for example, as soon as the predetermined number of pulses of the CW pulse signal preliminarily set is counted, the control unit 40 stops outputting the CW pulse signal to the stepping motor 7. Together with this, the control unit 40 turns the first solenoid valve 31 OFF (the SV1 is OFF) to turn the discharge valve 22 OFF. That is, as soon as the output of the CW pulse signal is stopped, the operation of the stepping motor 7 is also stopped, and thus, the ball screw 6 moving forward with the driving head 8 in the direction to crush the tubephragm 5 stops. When the first solenoid valve 31 is turned OFF, the air supplied to the discharge valve 22 stops. Therefore, the discharge valve 22 is turned OFF to close between the discharge port 5*b* and the pipe 25 and nozzle 26. This terminates the discharge operation of the tubephragm pump 1.

When the discharge operation is terminated, the control unit 40 stands by until a predetermined time T2 passes, and after a lapse of the predetermined time T2, the control unit 40 outputs the CCW pulse signal to the stepping motor 7. Together with this, the control unit 40 turns the second solenoid valve 32 ON (the SV2 is ON) to turn the suction valve 21 ON. It should be noted that the predetermined time T2 is a time period during which the operation is once stopped in order to prevent the stepping motor 7 from stepping out after the termination of the discharge operation and is preferred to be 0.5 seconds or more.

As described above, as soon as the CCW pulse signal is output, the stepping motor 7 retreats the ball screw 6 such that the ball screw 6 pulls the tubephragm 5 with the driving head 8. As soon as the second solenoid valve 32 is turned ON, the air supplied from the air supply source 30 to the second solenoid valve 32 via the pressure regulating valve 33 turns the suction valve (air controlled valve) 21 ON to open between the suction port 5*a* and the pipe 23 and resist bottle 24. This starts the suction operation of the tubephragm pump 1.

As soon as the suction operation starts, the pump chamber 4 of the tubephragm 5 have the liquid contacting surfaces 4*a* and 4*b* being directly pulled by the driving head 8 to continue separating. This introduces the resist R by the volume displaced by an expansion of the pump chamber 4 into the pump chamber 4 through the pipe 23, the suction valve 21, and the suction port 5*a* from the resist bottle 24.

During the suction operation, at the timing when the blocking plate 9 mounted on the lower end portion of the driving member 8*c* of the driving head 8 is detected by the home position sensor 10 or at a predetermined timing preliminarily set, the control unit 40 stops outputting the CCW pulse signal to the stepping motor 7. As soon as the output of the CCW pulse signal stops, the operation of the stepping motor 7 also stops, and therefore, the ball screw 6 that has been retreating with the driving head 8 so as to expand the tubephragm 5 stops at the original position.

As soon as the suction operation is terminated, the control unit 40 stands by until a predetermined time T3 passes, and after a lapse of the predetermined time T3, the control unit 40 turns the second solenoid valve 32 OFF (the SV2 is OFF) to turn the suction valve 21 OFF. That is, the second solenoid valve 32 being turned OFF stops the air supplied to the suction valve 21, and therefore, the suction valve 21 is turned OFF to close between the suction port 5*a* and the pipe 23 and resist bottle 24. This terminates the suction operation of the tubephragm pump 1 to provide the standby state again. As described above, the tubephragm pump 1 completes one cycle of operation. It should be noted that the above-described predetermined times T0 to T3 are time periods that can be arbitrarily set.

Figure 9:
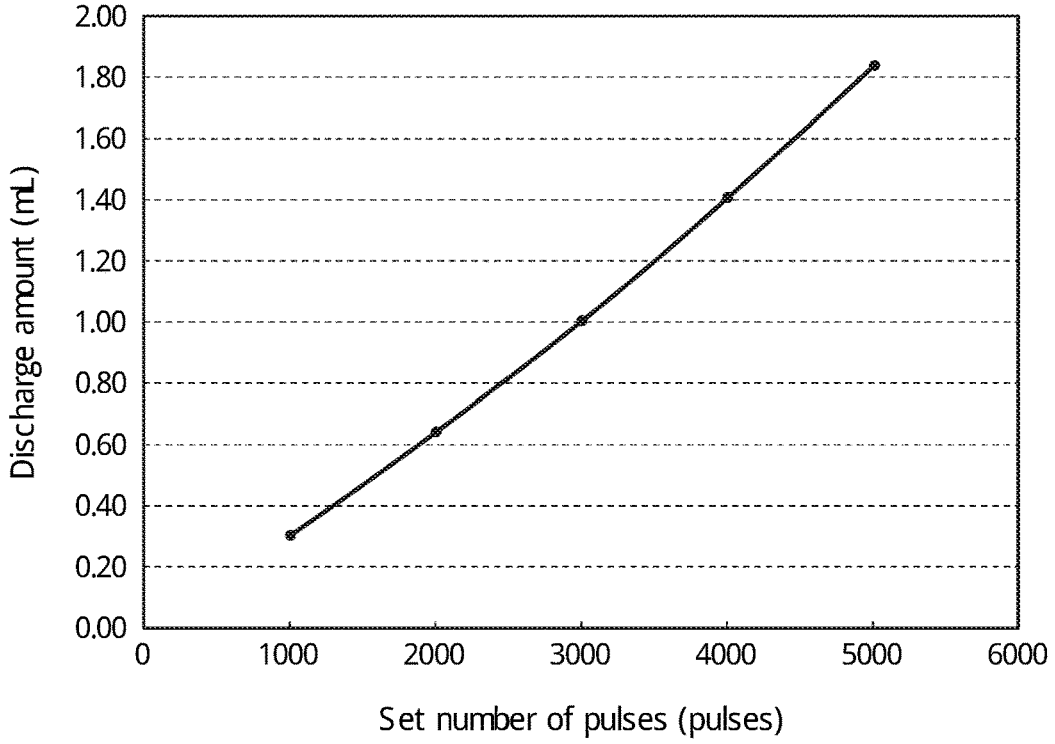
FIG. 9 is a graph that illustrates a linearity of the operation of the same tubephragm pump.

In the tubephragm pump 1 thus operating, a lateral cross-sectional shape of the pump head portion 5*c* of the tubephragm 5 is in a flat shape. Therefore, a relationship between the discharge amount of the resist R and the deformation amount (crushing amount) of the pump chamber 4 shows an approximate linearity as plotted in a graph with the discharge amount (mL) by the pump on the vertical axis and the set number of pulses (pulse) on the horizontal axis, as illustrated in FIG. 9. In this embodiment, since the tubephragm 5 is directly driven by controlling the number of pulses of the stepping motor 7, a resolution is higher than that of an air driven type, and, for example, it is possible to control the flow rate at a level of 0.01 mL. In view of this, it becomes easy to change the maximum discharge amount of the tubephragm pump 1 and design an applicable discharging range.

Other Embodiments

Figure 10:
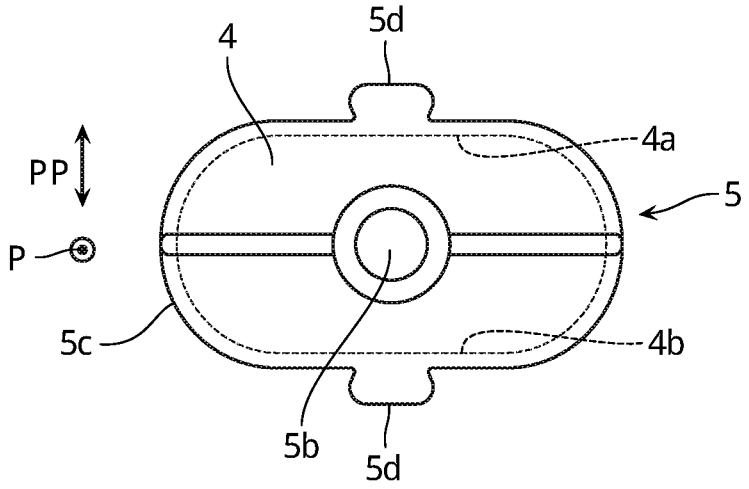
FIG. 10 is a cross-sectional view that illustrates a tubephragm of a tubephragm pump according to another embodiment of the present invention.

It should be noted that the shape of the tubephragm 5 is not limited to the shape of the above-described embodiment. For example, the tubephragm 5 may have the pump head portion 5*c*, which forms the pump chamber 4, having the following cross-sectional shape. That is, as illustrated in FIG. 10, the pump chamber 4 of the tubephragm 5 is formed to have a lateral cross-sectional shape perpendicular to the transfer direction P in, for example, an oval-like shape in another embodiment.

Figure 11:
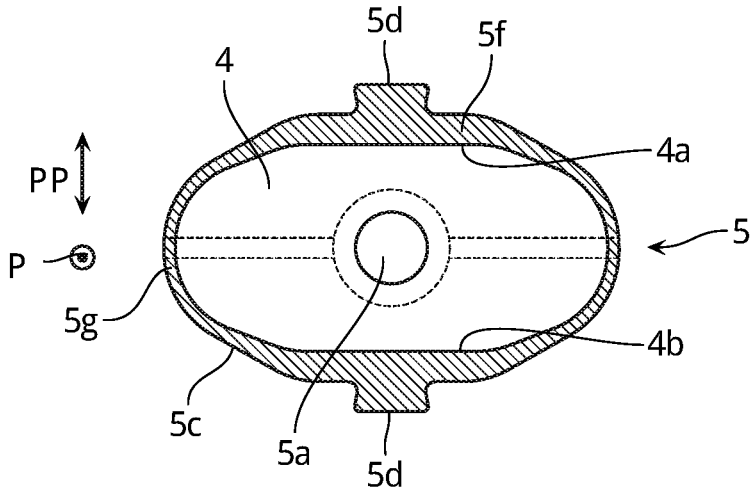
FIG. 11 is a cross-sectional view that illustrates a tubephragm of a tubephragm pump according to yet another embodiment of the present invention.

As illustrated in FIG. 11, in yet another embodiment, the pump chamber 4 of the tubephragm 5 may be approximately in an elliptical shape or an oval-like shape, and may have wall portions 5*f* opposing in the driving direction PP on the cross-sectional surface perpendicular to the transfer direction P of the pump chamber 4, that is, a wall thickness of portions having a small deformation amount being formed to be thicker than a wall portion 5*g* corresponding to a direction perpendicular to the driving direction PP, that is, a wall thickness of portions having a large deformation amount.

Even in these embodiments, the pump chamber 4 of the tubephragm 5 has a flat shape with an interval between the liquid contacting surfaces 4*a* and 4*b* opposing in the driving direction PP shorter than an interval between the opposed surfaces in a direction perpendicular to this, thereby ensuring providing the linearity between the above-described deformation amount and discharge amount. In particular, in the tubephragm 5 illustrated in FIG. 11, changing the wall thickness of the pump chamber 4 facilitates maintaining the shape of the liquid contacting surfaces 4*a* and 4*b* that mutually advance and retreat. Therefore, the linearity between the deformation amount (crushing amount) of the pump chamber 4 and the discharge amount is further improved, thereby further facilitating the quantitative determination control.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the gist of the inventions. The accompanying claims and their equivalents are intended to cover such forms or modifications as would fall within the scope and gist of the inventions.

Remarks

The description has disclosed, for example, the following aspects.

(Additional Remark 1) A tubephragm pump including:

a tubephragm that has a pump head portion that forms a pump chamber into which a transfer fluid is introduced and from which the introduced transfer fluid is discharged to an outside;

a driving head that holds the tubephragm, the driving head expanding and contracting the pump chamber by directly pressing and pulling the pump head portion in a direction intersecting with a transfer direction of the transfer fluid;

a driving unit that drives the driving head back and forth in a driving direction to expand and contract the pump chamber; and a control unit that controls the driving unit, wherein the tubephragm is in a flat shape with a cross-sectional shape intersecting with the transfer direction of the transfer fluid of the pump chamber having a length in a direction intersecting with the driving direction by the driving unit longer than a length in the driving direction by the driving unit, and a pair of liquid contacting surfaces opposing in the driving direction of the pump chamber move while maintaining a parallel state.

(Additional Remark 2) The tubephragm pump according to Additional Remark 1, wherein the control unit controls the driving unit such that the driving head is driven back and forth with a stroke with which the pair of liquid contacting surfaces opposing in the driving direction of the pump chamber are not brought into contact with one another.

(Additional Remark 3) The tubephragm pump according to Additional Remark 1, wherein the tubephragm has a rib that projects outward in the driving direction of the pump chamber on an outer peripheral surface side of the pump chamber.

(Additional Remark 4) The tubephragm pump according to Additional Remark 3, wherein the driving head includes a fixing member that sandwiches the rib.

(Additional Remark 5) The tubephragm pump according to Additional Remark 1, wherein the tubephragm has a cross-sectional shape perpendicular to the transfer direction of the pump chamber in a hexagonal shape, an oval-like shape, or an elliptical shape.

(Additional Remark 6) The tubephragm pump according to Additional Remark 1, wherein the tubephragm has a wall thickness of wall portions opposing in the driving direction thicker than a wall thickness of wall portions opposing in a direction intersecting with the driving direction on a cross-sectional surface perpendicular to the transfer direction of the pump chamber.

(Additional Remark 7) A tubephragm pump including:

a tubephragm that has a pump head portion that forms a pump chamber into which a transfer fluid is introduced and from which the introduced transfer fluid is discharged to an outside;

a driving head that holds the tubephragm, the driving head expanding and contracting the pump chamber by directly pressing and pulling the pump head portion in a direction intersecting with a transfer direction of the transfer fluid;

a driving unit that drives the driving head back and forth in a driving direction to expand and contract the pump chamber; and a control unit that controls the driving unit, wherein the tubephragm is in a flat shape with a cross-sectional shape intersecting with the transfer direction of the transfer fluid of the pump chamber having a length in a direction intersecting with the driving direction by the driving unit longer than a length in the driving direction by the driving unit, and the pump head portion has a width wider than both end portions in the transfer direction of the transfer fluid.

(Additional Remark 8) The tubephragm pump according to Additional Remark 7, wherein the control unit controls the driving unit such that the driving head is driven back and forth with a stroke with which a pair of liquid contacting surfaces opposing in the driving direction of the pump chamber are not brought into contact with one another.

(Additional Remark 9) The tubephragm pump according to Additional Remark 7, wherein the tubephragm has a rib that projects outward in the driving direction of the pump chamber on an outer peripheral surface side of the pump chamber.

(Additional Remark 10) The tubephragm pump according to Additional Remark 9, wherein the driving head includes a fixing member that sandwiches the rib.

(Additional Remark 11) The tubephragm pump according to Additional Remark 7, wherein the tubephragm has a cross-sectional shape perpendicular to the transfer direction of the pump chamber in a hexagonal shape, an oval-like shape, or an elliptical shape.

(Additional Remark 12) The tubephragm pump according to Additional Remark 7, wherein the tubephragm has a wall thickness of wall portions opposing in the driving direction thicker than a wall thickness of wall portions opposing in a direction intersecting with the driving direction on a cross-sectional surface perpendicular to the transfer direction of the pump chamber.

(Additional Remark 13) A tubephragm pump including:

a tubephragm that has a pump head portion that forms a pump chamber into which a transfer fluid is introduced and from which the introduced transfer fluid is discharged to an outside;

a driving head that holds the tubephragm, the driving head expanding and contracting the pump chamber by directly pressing and pulling the pump head portion in a second direction intersecting with a first direction as a transfer direction of the transfer fluid, a driving unit that drives the driving head back and forth in the second direction; and a control unit that controls the driving unit, wherein the tubephragm has a flat shape with a cross-sectional shape intersecting with the first direction of the pump head portion having a length in a third direction intersecting with the first direction and the second direction longer than a length in the second direction, the pump head portion has one side in the first direction where a suction port is provided and another side where a discharge port is provided, and the pump head portion has a cross-sectional surface intersecting with the first direction larger than a cross-sectional surface intersecting with the first direction of the suction port and the discharge port.

(Additional Remark 14) The tubephragm pump according to Additional Remark 13, wherein the control unit controls the driving unit such that the driving head is driven back and forth with a stroke with which a pair of liquid contacting surfaces opposing in the second direction of the pump chamber are not brought into contact with one another.

(Additional Remark 15) The tubephragm pump according to Additional Remark 13, wherein the tubephragm has a rib that projects outward in the second direction of the pump chamber on an outer peripheral surface side of the pump chamber.

(Additional Remark 16) The tubephragm pump according to Additional Remark 15, wherein the driving head includes a fixing member that sandwiches the rib.

(Additional Remark 17) The tubephragm pump according to Additional Remark 13, wherein the tubephragm has a cross-sectional shape perpendicular to the first direction of the pump chamber in a hexagonal shape, an oval-like shape, or an elliptical shape.

(Additional Remark 18) The tubephragm pump according to Additional Remark 13, wherein the tubephragm has a wall thickness of wall portions opposing in the second direction thicker than a wall thickness of wall portions opposing in the third direction on a cross-sectional surface perpendicular to the first direction of the pump chamber.

(Additional Remark 19) The tubephragm pump according to any one of Additional Remarks 1, 7, or 13, wherein the tubephragm is formed by blow molding.

(Additional Remark 20) The tubephragm pump according to any one of Additional Remarks 1, 7, or 13, wherein the tubephragm is formed of a perfluoroalkoxy alkane.

What is claimed is:

1. A tubephragm pump comprising:

a tubephragm that has a suction port, a discharge port and a pump head portion arranged between the suction port and the discharge port, the suction port, the pump head portion and the discharge port being aligned in a first direction which is a longitudinal direction of the tubephragm, the pump head portion forming a pump chamber into which a transfer fluid is introduced through the suction port and from which the introduced transfer fluid is discharged through the discharge port to an outside;

a driving head that holds the tubephragm, the driving head expanding and contracting the pump chamber by directly pressing and pulling the pump head portion in a second direction intersecting with the first direction;

a driving unit that drives the driving head back and forth in the second direction to expand and contract the pump chamber; and a control unit that controls the driving unit, wherein a cross-sectional shape of the pump chamber intersecting with the first direction has a first length in a third direction intersecting with the first direction and the second direction, and has a second length in the second direction, the first length being longer than the second length, and a pair of inner surfaces of the pump chamber opposing each other in the second direction move while maintaining a parallel state.

2. The tubephragm pump according to claim 1, wherein the control unit controls the driving unit such that the driving head is driven back and forth with a stroke with which the pair of inner surfaces of the pump chamber opposing each other in the second direction are not brought into contact with one another.

3. The tubephragm pump according to claim 1, wherein the tubephragm has a rib that projects outward in the second direction of the pump chamber on an outer peripheral surface side of the pump chamber.

4. The tubephragm pump according to claim 3, wherein the driving head includes a fixing member that sandwiches the rib.

5. The tubephragm pump according to claim 1, wherein the cross-sectional shape of the pump chamber intersecting with the first direction is a hexagonal shape, an oval-like shape, or an elliptical shape.

6. The tubephragm pump according to claim 1, wherein the pump head portion of the tubephragm has first wall portions opposing each other in the second direction and second wall portions opposing each other in the third direction, a wall thickness of each of the first wall portions is thicker than a wall thickness of each of the second wall portions.

7. A tubephragm pump comprising:

a tubephragm that has a suction port, a discharge port and a pump head portion arranged between the suction port and the discharge port, the suction port, the pump head portion and the discharge port being aligned in a first direction which is a longitudinal direction of the tubephragm, the pump head portion forming a pump chamber into which a transfer fluid is introduced through the suction port and from which the introduced transfer fluid is discharged through the discharge port to an outside;

a driving head that holds the tubephragm, the driving head expanding and contracting the pump chamber by directly pressing and pulling the pump head portion in a second direction intersecting with the first direction;

a driving unit that drives the driving head back and forth in the second direction to expand and contract the pump chamber; and a control unit that controls the driving unit, wherein a cross-sectional shape of the pump chamber intersecting with the first direction has a first length in a third direction intersecting with the first direction and the second direction, and has a second length in the second direction, the first length being longer than the second length, and the pump head portion has a width in the third direction wider than each width of the suction port and the discharge port in the third direction.

8. The tubephragm pump according to claim 7, wherein the control unit controls the driving unit such that the driving head is driven back and forth with a stroke with which a pair of inner surfaces of the pump chamber opposing each other in the second direction are not brought into contact with one another.

9. The tubephragm pump according to claim 7, wherein the tubephragm has a rib that projects outward in the second direction of the pump chamber on an outer peripheral surface side of the pump chamber.

10. The tubephragm pump according to claim 9, wherein the driving head includes a fixing member that sandwiches the rib.

11. The tubephragm pump according to claim 7, wherein the cross-sectional shape of the pump chamber intersecting with the first direction is a hexagonal shape, an oval-like shape, or an elliptical shape.

12. The tubephragm pump according to claim 7, wherein the pump head portion of the tubephragm has first wall portions opposing each other in the second direction and second wall portions opposing each other in the third direction, a wall thickness of each of the first wall portions is thicker than a wall thickness of each of the second wall portions.

13. A tubephragm pump comprising:

a tubephragm that has a suction port, a discharge port and a pump head portion arranged between the suction port and the discharge port, the suction port, the pump head portion and the discharge port being aligned in a first direction which is a longitudinal direction of the tubephragm, the pump head portion forming a pump chamber into which a transfer fluid is introduced through the suction port and from which the introduced transfer fluid is discharged through the discharge port to an outside;

a driving head that holds the tubephragm, the driving head expanding and contracting the pump chamber by directly pressing and pulling the pump head portion in a second direction intersecting with the first direction, a driving unit that drives the driving head back and forth in the second direction; and a control unit that controls the driving unit, wherein a cross-sectional shape of the pump chamber intersecting with the first direction has a first length in a third direction intersecting with the first direction and the second direction, and has a second length in the second direction, the first length being longer than the second length, and a cross-sectional surface of the pump head portion intersecting with the first direction is larger than each cross-sectional surface of the suction port and the discharge port intersecting with the first direction.

14. The tubephragm pump according to claim 13, wherein the control unit controls the driving unit such that the driving head is driven back and forth with a stroke with which a pair of inner surfaces of the pump chamber opposing each other in the second direction are not brought into contact with one another.

15. The tubephragm pump according to claim 13, wherein the tubephragm has a rib that projects outward in the second direction of the pump chamber on an outer peripheral surface side of the pump chamber.

16. The tubephragm pump according to claim 15, wherein the driving head includes a fixing member that sandwiches the rib.

17. The tubephragm pump according to claim 13, wherein the cross-sectional shape of the pump chamber intersecting with the first direction is a hexagonal shape, an oval-like shape, or an elliptical shape.

18. The tubephragm pump according to claim 13, wherein the pump head portion of the tubephragm has first wall portions opposing each other in the second direction and second wall portions opposing each other in the third direction, a wall thickness of each of the first wall portions being thicker than a wall thickness of each of the second wall portions.

19. The tubephragm pump according to claim 13, wherein the tubephragm is formed by blow molding.

20. The tubephragm pump according to claim 13, wherein the tubephragm is formed of a perfluoroalkoxy alkane.

* * * * *